US008029087B2

(12) United States Patent
Kusunoki

(10) Patent No.: US 8,029,087 B2
(45) Date of Patent: Oct. 4, 2011

(54) DROPLET EJECTION APPARATUS AND DROPLET EJECTION METHOD

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 302 days.

(21) Appl. No.: 12/398,616

(22) Filed: Mar. 5, 2009

(65) Prior Publication Data

US 2009/0225118 A1 Sep. 10, 2009

(30) Foreign Application Priority Data

Mar. 6, 2008 (JP) ..... 2008-056374

(51) Int. Cl.
*B41J 29/393* (2006.01)

(52) U.S. Cl. ..... 347/19

(58) Field of Classification Search ..... 347/15, 347/43, 41, 96, 98, 19, 95
See application file for complete search history.

(56) References Cited

U.S. PATENT DOCUMENTS 5,959,641 A * 9/1999 Yokoi ..... 347/21

FOREIGN PATENT DOCUMENTS

JP 2007-83180 A 4/2007

* cited by examiner

*Primary Examiner* — Lamson Nguyen
(74) *Attorney, Agent, or Firm* — Birch, Stewart, Kolasch & Birch, LLP

(57) ABSTRACT

A droplet ejection apparatus includes: a treatment liquid deposition device which deposits treatment liquid aggregating ink onto a medium; an ink droplet ejection device which ejects droplets of ink onto the medium on which the treatment liquid has been deposited; and a droplet ejection correction device which corrects a droplet ejection volume of the ink droplet ejection device in accordance with distribution of the treatment liquid on the medium.

12 Claims, 15 Drawing Sheets

DROPLET EJECTION APPARATUS AND DROPLET EJECTION METHOD

BACKGROUND OF THE INVENTION

1. Field of the Invention

The present invention relates to a droplet ejection apparatus and a droplet ejection method whereby ink droplets are ejected onto a medium after depositing an ink aggregating treatment liquid onto the medium.

2. Description of the Related Art

Technology is known in which droplets of ink are ejected after depositing an ink aggregating treatment liquid onto a medium. For example, Japanese Patent Application Publication No. 2007-83180 discloses a small printer which applies a treatment liquid to a medium before the ejection of ink droplets, by using a round cylindrical application roller.

In a small printer, generally, a so-called shuttle type of ink droplet ejection head is used, which moves back and forth reciprocally in the direction (main scanning direction) that is perpendicular to the medium conveyance direction, and therefore intermittent conveyance is carried out by repeating conveyance and halting of the medium at the ink droplet ejection position. In a small printer of this kind, generally, in order to make the apparatus compact in size, the medium is also conveyed in an intermittent fashion at the position of the treatment liquid application roller, in accordance with the ejection of ink droplets, and therefore variation in the application of the treatment liquid arises due to variation in the conveyance speed. Furthermore, since the treatment liquid proceeds to permeate into the medium when the conveyance of the medium is halted, then there is a tendency for the amount of treatment liquid applied to increase. If there are variations in the application of the treatment liquid, then variations in aggregation occur when the ink aggregates, and ultimately, density non-uniformities arise in the image.

A countermeasure considered in order to prevent variations in the application of treatment liquid as described above involves providing a buffer which withdraws the medium (for example, a loop-shaped withdrawal path), between the treatment liquid application roller and the droplet ejection head. By this means, even if the medium is halted at the ink droplet ejection position, it is possible to apply treatment liquid by conveying the medium in a continuous fashion, at the treatment liquid application position, but on the other hand problems arise in that in order to provide space for the buffer, the apparatus becomes large in size and costs increase.

Furthermore, even if treatment liquid is deposited onto the medium by droplet ejection, in cases where the resolution of the droplet ejection of the treatment liquid is made lower than the resolution of the droplet ejection of ink or the treatment liquid droplets are ejected in a thinned out fashion with the objective of saving component costs for the ejection of treatment liquid droplets and saving running costs due to reduced consumption of the treatment liquid, variations in the aggregation of the ink arise due to variations in the amount of treatment liquid deposited onto the medium, similarly to cases where treatment liquid is deposited by application as described above, and hence there has been a problem of density non-uniformities in the image.

SUMMARY OF THE INVENTION

The present invention has been contrived in view of the foregoing, an object thereof being to provide a droplet ejection apparatus and a droplet ejection method whereby, even in cases where there is variation in the volume of treatment liquid deposited onto a medium, density non-uniformities in an image caused by variation in the aggregation of ink on the medium can be reduced, while restricting increase in the size of the apparatus.

In order to attain an object described above, one aspect of the present invention is directed to a droplet ejection apparatus, comprising: a treatment liquid deposition device which deposits treatment liquid aggregating ink onto a medium; an ink droplet ejection device which ejects droplets of ink onto the medium on which the treatment liquid has been deposited; and a droplet ejection correction device which corrects a droplet ejection volume of the ink droplet ejection device in accordance with distribution of the treatment liquid on the medium.

According to this aspect of the invention, even in cases where there is variation in the treatment liquid deposition volume on the medium, the droplet ejection volume of the ink droplet ejection device is corrected in accordance with the distribution of the treatment liquid on the medium, and therefore it is possible to reduce density non-uniformities in the image caused by variations in the aggregation of ink on the medium, without making the apparatus large in size in order to achieve uniform distribution of the treatment liquid on the medium.

Desirably, the droplet ejection apparatus further comprises: a medium conveyance device which conveys the medium relatively with respect to the treatment liquid deposition device and the ink droplet ejection device; and a droplet ejection correction region identification device which identifies a droplet ejection correction region in which a deposition volume of the treatment liquid on the medium changes in accordance with variation in a conveyance speed of the medium by the medium conveyance device, wherein the treatment liquid deposition device is an application roller which applies the treatment liquid while making contact with the medium, and wherein the droplet ejection correction device corrects the droplet ejection volume of the ink droplet ejection device onto the droplet ejection correction region identified by the droplet ejection correction region identification device.

Here, the medium conveyance device is not limited in particular to a mode where the medium is moved with respect to both the application roller and the ink droplet ejection device, and it is also possible to adopt a mode in which both the application roller and the ink droplet ejection device are moved with respect to the medium. The relationship between the application roller and the medium is not restricted in particular to a case where the medium is conveyed in a state where the medium surface does not slide with respect to the surface of the application roller, and the present invention also encompasses cases where the medium is conveyed in a state where the surface of the medium slides with respect to the surface of the application roller. Furthermore, the application roller is not limited to a roller which rotates passively due to the movement of the medium, and the present invention also encompasses cases where the medium moves passively due to the rotation of the application roller (in other words, where the application roller also serves as a medium conveyance device).

According to this aspect of the invention, even in cases where there is variation in the deposition volume of the treatment liquid on the medium due to the variation in the conveyance speed of the medium, a region where the deposition volume of the treatment liquid on the medium changes in accordance with variation in the conveyance speed of the medium is identified, and the droplet ejection of the ink droplet ejection device onto this region is corrected, and therefore it is possible to reduce density non-uniformities in the image caused by variation in the aggregation of ink on the medium, without causing increase in the size of the apparatus in order to achieve uniform distribution of the treatment liquid on the medium.

Desirably, the ink droplet ejection device is an ink droplet ejection head which ejects the droplets of ink onto the medium while moving reciprocally back and forth in a main scanning direction which is perpendicular to a medium conveyance direction in which the medium is conveyed by the medium conveyance device, and the medium conveyance device performs intermittent conveyance which repeats conveyance and halting of the medium in contact with the application roller, in accordance with the reciprocal movement of the ink droplet ejection head.

According to this aspect of the invention, even in cases where there is variation in the deposition volume of the treatment liquid on the medium due to the intermittent conveyance of the medium which contacts the application roller in accordance with the reciprocal movement of the droplet ejection head which ejects ink droplets, then density non-uniformities in the image cause by variation in the aggregation of the ink on the medium are reduced.

Desirably, the droplet ejection correction region identification device identifies, as the droplet ejection correction region, a halt region on the medium which lies in contact with the application roller when the medium is halted, and the droplet ejection correction device increases the droplet ejection volume of the ink droplet ejection device onto the halt region.

According to this aspect of the invention, since a halt region on the medium which lies in contact with the application roller when the conveyance of the medium is halted is identified, and the droplet ejection volume of the ink for this halt region is increased, then even in cases where there is variation in the deposition volume of the treatment liquid on the medium due to the halting of the medium, it is possible to reduce density non-uniformities in the image caused by variation in the aggregation of the ink on the medium.

Desirably, the droplet ejection correction device raises an amount of increase in the droplet ejection volume onto a halt region on the medium which lies in contact with the application roller when the medium is halted, as a halt time when the medium is halted becomes longer.

According to this aspect of the invention, even in cases where there is variation in the deposition volume of the treatment liquid in the halt region in accordance with variation in halt time of the medium, the density non-uniformities of the image caused by variation in the aggregation of the ink on the medium can be appropriately reduced.

Desirably, the droplet ejection correction device raises an amount of increase in the droplet ejection volume onto a halt region on the medium which lies in contact with the application roller when the medium is halted, as a speed of movement of the ink droplet ejection head in the main scanning direction during application of the treatment liquid becomes lower.

According to this aspect of the invention, even in cases where there is variation in the deposition volume of the treatment liquid in the halt region due to change in the movement speed setting of the ink droplet ejection head in the main scanning direction as a result of switching of the image forming mode, such as high-quality mode and high-speed mode or the like, the density non-uniformities of the image caused by variation in the aggregation of the ink on the medium can be easily reduced.

Desirably, the ink droplet ejection head has a plurality of nozzles, and the droplet ejection correction device performs aggregation correction of correcting density non-uniformities of an image caused by variation in aggregation of the ink in accordance with variation in deposition of the treatment liquid onto the medium, and joint correction of correcting density non-uniformities of an image in a joint region on the medium in terms of the medium conveyance direction caused by variation in an amount of movement of the medium in the medium conveyance direction, the aggregation correction being carried out by using a nozzle other than a nozzle used for the joint correction, of the plurality of nozzles of the ink droplet ejection head.

According to this aspect of the invention, in the aggregation correction and joint correction, correction can be carried out by using mutually independent correction volumes, and therefore the correction control becomes easy.

Desirably, the droplet ejection correction device raises an amount of increase in the droplet ejection volume onto a region of the medium, as a deposition volume of the treatment liquid per unit surface area is greater.

According to this aspect of the invention, it is possible suitably to reduce the density non-uniformities in the image caused by variation in the aggregation of the ink in accordance with the variation in the deposition of treatment liquid onto the medium.

Desirably, the droplet ejection correction device raises the amount of increase in the droplet ejection volume onto a region of the medium, as a thickness of a layer of the treatment liquid is greater.

According to this aspect of the invention, the amount of increase in the ink droplet ejection volume changes in accordance with the thickness of the layer of treatment liquid on the medium, and therefore it is possible suitably to reduce density non-uniformities caused by variation in the aggregation of the ink on the medium.

Desirably, the treatment liquid deposition device has a plurality of nozzles which eject droplets of the treatment liquid onto the medium, and the droplet ejection correction device corrects the droplet ejection volume of the ink droplet ejection device in accordance with an overlapping surface area of treatment liquid dots and ink dots formed on the medium.

According to this aspect of the invention, in cases where, for example, the treatment liquid droplets are ejected in thinned out fashion and the resolutions of the treatment liquid dots and the ink dots are set to be different with the objective of preventing curling of the medium due to the treatment liquid or reducing the consumption of the treatment liquid, it is possible to reduce density non-uniformities in the image caused by variation in the aggregation of the ink.

Desirably, the droplet ejection correction device raises an amount of increase in the droplet ejection volume for an ink dot with a greater overlapping surface area with the treatment liquid dot, of the ink dots on the medium.

According to this aspect of the invention, the amount of increase in the ink droplet ejection volume changes in accordance with the overlapping surface area between the treatment liquid dots and the ink dots, and therefore it is possible suitably to reduce density non-uniformities caused by variation in the aggregation of the ink on the medium.

In order to attain an object described above, another aspect of the present invention is directed to a droplet ejection method of ejecting droplets of ink onto a medium on which treatment liquid aggregating the ink has been deposited, the droplet ejection method comprising the step of correcting a droplet ejection volume of an ink droplet ejection device in accordance with distribution of the treatment liquid on the medium.

Desirably, an application roller which applies the treatment liquid while making contact with the medium, an ink droplet ejection device which ejects the droplets of ink onto the medium on which the treatment liquid has been deposited, and a medium conveyance device which conveys the medium relatively with respect to the application roller and the ink droplet ejection device, are used, and a droplet ejection correction region in which a deposition volume of the treatment liquid on the medium changes in accordance with variation in a conveyance speed of the medium by the medium conveyance device is identified, and the droplet ejection volume of the ink droplet ejection device is corrected for the droplet ejection correction region.

Desirably, a treatment liquid droplet ejection head having a plurality of nozzles which eject droplets of the treatment liquid onto the medium, and an ink droplet ejection head having a plurality of nozzles which eject the droplets of ink onto the medium on which the droplets of the treatment liquid have been ejected, are used, and the droplet ejection volume of the ink droplet ejection head is corrected in accordance with an overlapping surface area between treatment liquid dots formed on the medium by the treatment liquid droplet ejection head and ink dots formed on the medium by the ink droplet ejection head.

According to the present invention, even in cases where there is variation in the deposition volume of treatment liquid on the medium, it is possible to reduce density non-uniformities in the image caused by variation in the aggregation of the ink on the medium.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
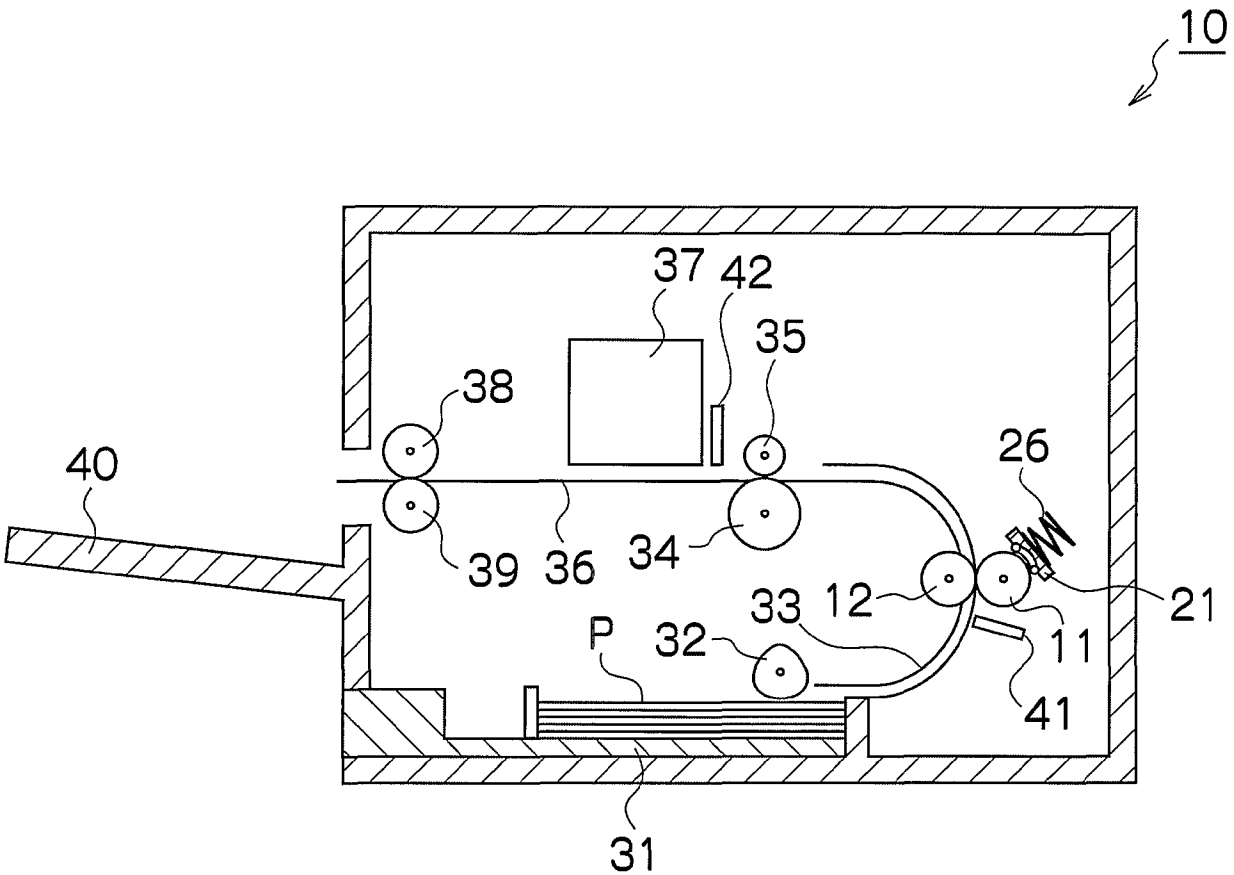
FIG. 1 is a general schematic drawing of an image forming apparatus relating to a first embodiment to which a droplet ejection apparatus of an embodiment of the present invention is applied.

FIG. 1 is a general schematic drawing of an image forming apparatus 10 according to a first embodiment which employs a droplet ejection apparatus relating to an embodiment of the present invention.

In FIG. 1, a plurality of recording media P (hereinafter, called "media") are loaded into a paper supply unit 31. A feed roller 32 picks up the media P which are loaded in the paper supply unit 31, one sheet at a time, and conveys same to a conveyance path 33. An application roller 11 which applies a treatment liquid to the medium P and a back-up roller 12 which opposes the application roller 11 and supports the medium P are provided in the conveyance path 33. The liquid holding member 21 is impelled toward the outer circumferential surface of the application roller 11 by the impelling force of an impelling member 26, such as a spring member, and forms a liquid holding space between itself and the outer circumferential surface of the application roller 11 by abutting against the application roller 11. The medium P onto which treatment liquid has been applied due to the rotation of the application roller 11 is conveyed onto a platen 36 by a pair of conveyance rollers 34 and 35. The ink droplet ejection head 37 forms an image by ejecting droplets of ink onto the medium P on the platen 36. The medium P on which the image has been formed is output to an output tray 40 by the output rollers 38 and 39.

Medium leading edge determination sensors 41 and 42 which determine the leading edge of the medium P are provided in the conveyance path 33. The first medium leading edge determination sensor 41 is disposed in the vicinity of the input to the application roller 11 on the paper supply side. The second medium leading edge determination sensor 42 is disposed in the vicinity of the input to the ink droplet ejection head 37 on the paper supply side.

Figure 2:
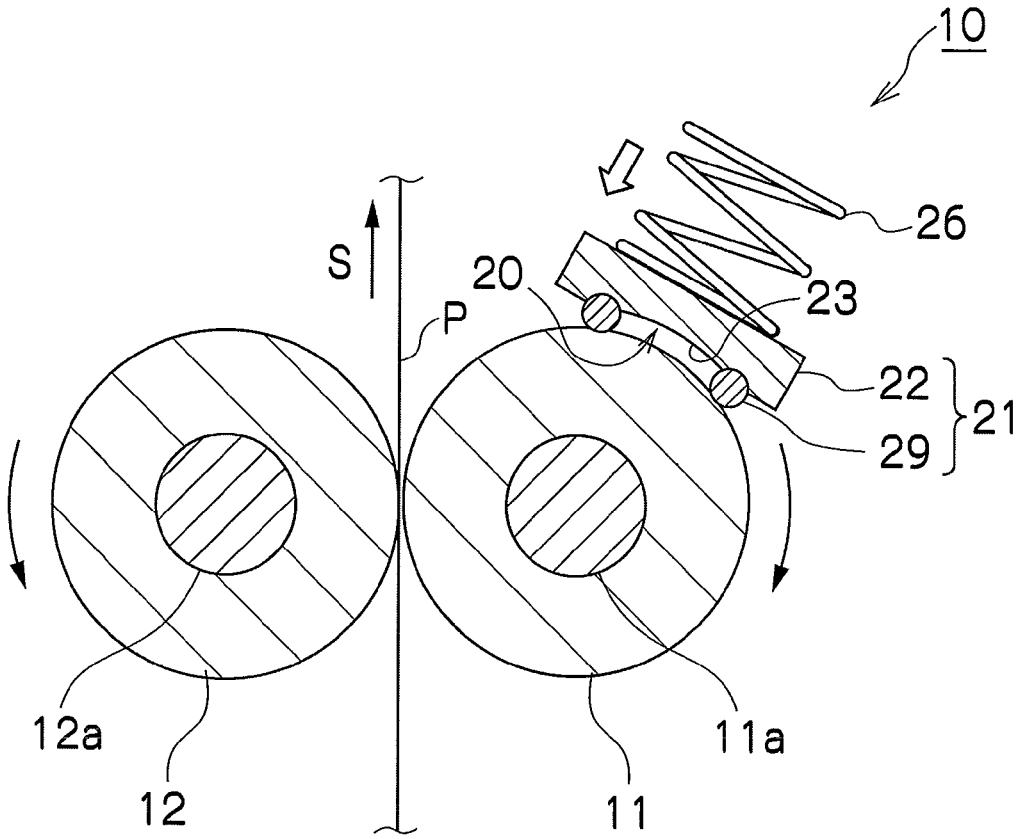
FIG. 2 is a cross-sectional diagram illustrating one example of the arrangement of the application roller, back-up roller and liquid holding member in FIG. 1.

FIG. 2 is a cross-sectional diagram illustrating one example of the arrangement of the application roller 11, the back-up roller 12 and the liquid holding member 21 of FIG. 1.

The application roller 11 and the back-up roller 12 are respectively supported rotatably by rotating shafts 11*a* and 12*a* which are provided in the axial direction which is perpendicular to the conveyance direction S of the medium P. Furthermore, the back-up roller 12 is impelled toward the outer circumferential surface of the application roller 11 by an impelling device (not illustrated). By means of the application roller 11 rotating in the clockwise direction in FIG. 2, the medium P is conveyed in the conveyance direction S in FIG. 2.

The liquid holding member 21 is constituted by a substrate 22 and an abutting section 29 which is provided in a projecting fashion on the surface of the substrate 22 opposing the application roller 11. A recess section 23 for creating a uniform interval with respect to the application roller 11 is formed on the face of the substrate 22 to which the abutting section 29 is fixed. The substrate 22 is impelled toward the outer circumferential surface of the application roller 11 by the impelling force of the impelling member 26, and the ring-shaped abutting section 29 is thereby abutted against the outer circumferential surface of the application roller 11. In this abutting state, a closed liquid holding space 20 is formed by the outer circumferential surface of the application roller 11 and the liquid holding member 21.

When the rotation of the application roller 11 is halted, a liquid-tight state is maintained between the liquid holding member 21 and the outer circumferential surface of the application roller 11, and hence the liquid can be prevented reliably from leaking to the exterior. Here, the liquid-tight state when the application roller 11 is in a halted state means that liquid does not pass between the interior and the exterior of the liquid holding space 20. In this case, the abutted state of the abutting section 29 includes, in addition to a state where the abutting section 29 makes direct contact with the outer circumferential side of the application roller 11, a state where the abutting section 29 abuts against the outer circumferential side of the application roller 11 via a film of liquid which is formed by capillary action.

On the other hand, in a state where the application roller 11 is rotated and the medium P is inserted in between the application roller 11 and the back-up roller 12, the liquid which has been applied to the outer circumferential side of the application roller 11 is transferred from the application roller 11 to the medium P.

Figure 3:
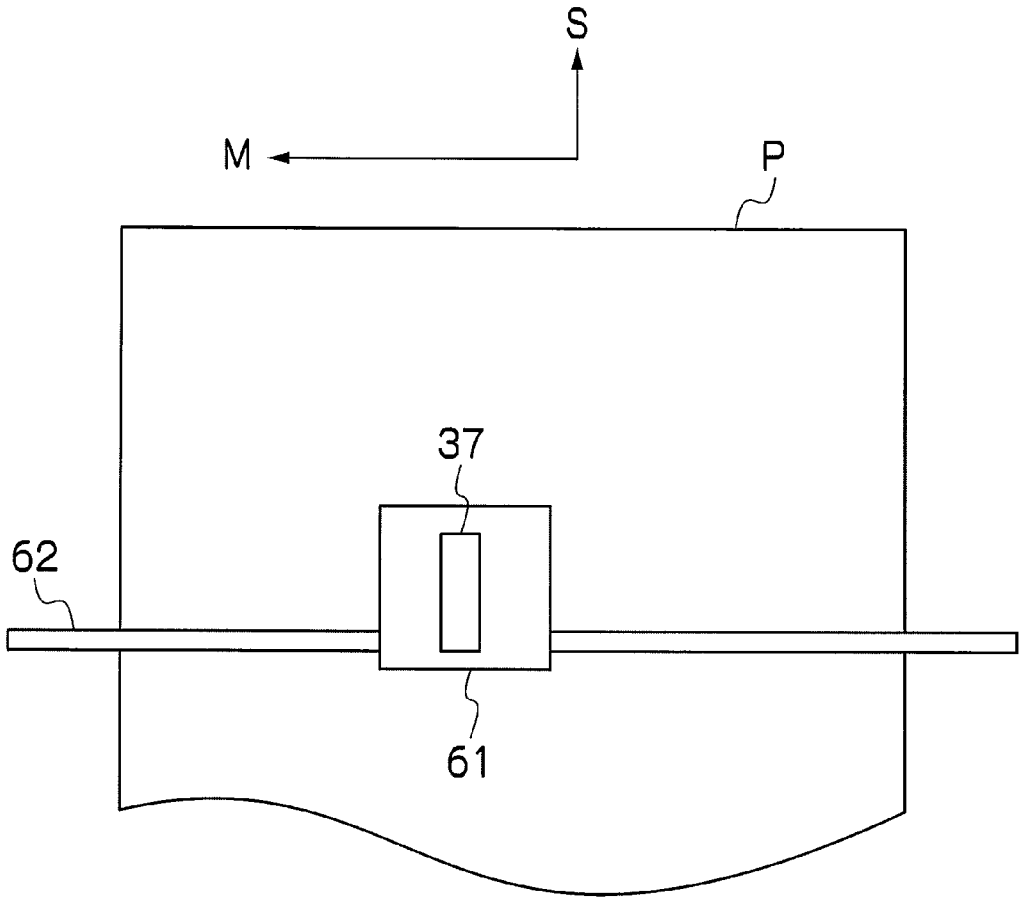
FIG. 3 is a plan diagram illustrating one example of an ink droplet ejection head.
Figure 4A:
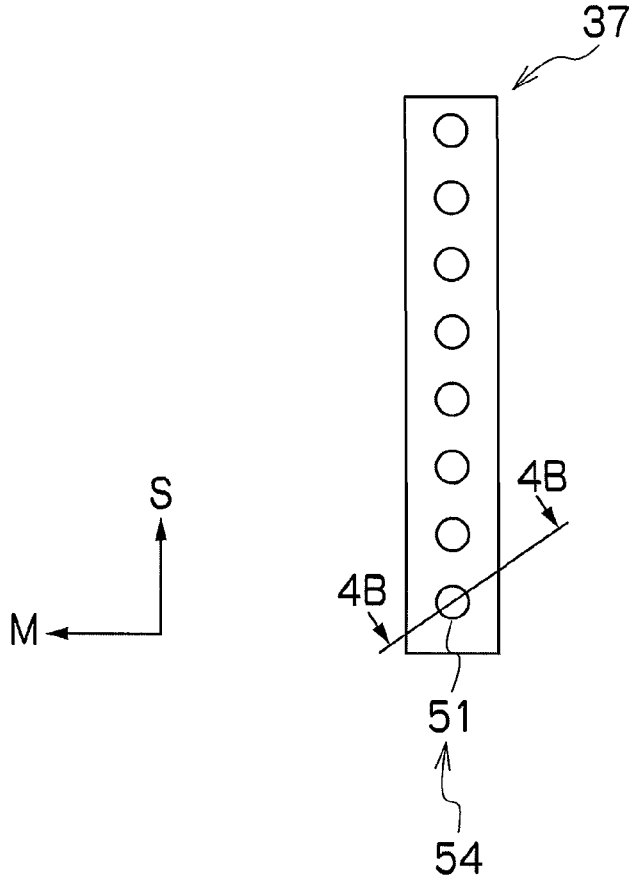
FIG. 4A is a bottom face view illustrating one example of an ink droplet ejection head.
Figure 4B:
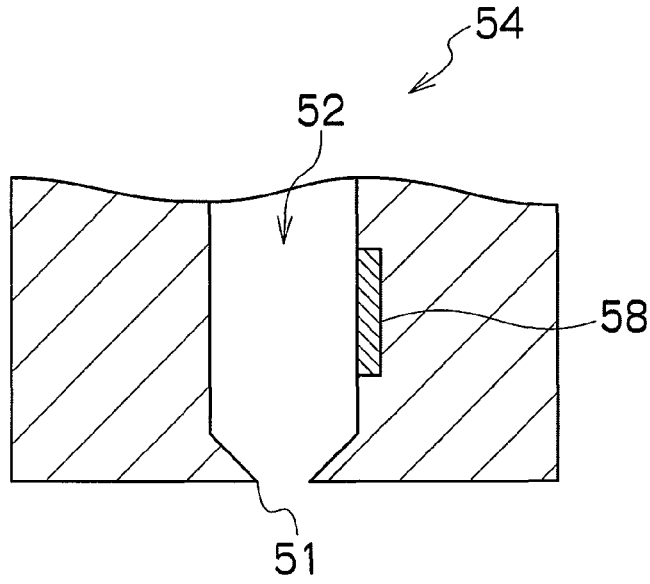
FIG. 4B is a cross-sectional view along line 4B-4B in FIG. 4A.

FIG. 3 is a plan diagram illustrating one example of the ink droplet ejection head 37 in FIG. 1 and the peripheral portion thereof. The ink droplet ejection head 37 according to the present example is a shuttle type (serial type) of droplet ejection head which moves back and forth reciprocally in the main scanning direction M which is perpendicular to the medium conveyance direction S (also called the "sub-scanning direction") below. The carriage 61 is guided by a guide 62 which is provided along the main scanning direction M, and moves the ink droplet ejection head 37. By this means, the ink droplet ejection head 37 moves relatively in the main scanning direction M with respect to the medium P. Furthermore, the medium P is conveyed in the sub-scanning direction S by the conveyance rollers (34 and 35 in FIG. 1). By this means, the ink droplet ejection head 37 moves relatively in the sub-scanning direction S with respect to the medium P. As illustrated by the bottom face diagram in FIG. 4A, a plurality of nozzles 51 are formed following the sub-scanning direction S in the ink droplet ejection head 37. The number of nozzles 51 and the arrangement of same are not limited in particular to the example illustrated in FIG. 4A. It is also possible to arrange the nozzles 51 in a so-called staggered matrix configuration. In FIG. 4B which illustrates a cross-sectional view along line 4B-4B in FIG. 4A, each of the liquid ejection elements 54 is constituted by: a nozzle 51 which ejects droplets of ink; a pressure chamber 52 into which ink is filled; and an actuator 58 which changes the internal pressure of the pressure chamber 52 by generating an air bubble inside the pressure chamber 52. One possible example of an actuator 58 is an electric heater which converts electrical energy into thermal energy. It is also possible to use a piezoelectric element.

Figure 5:
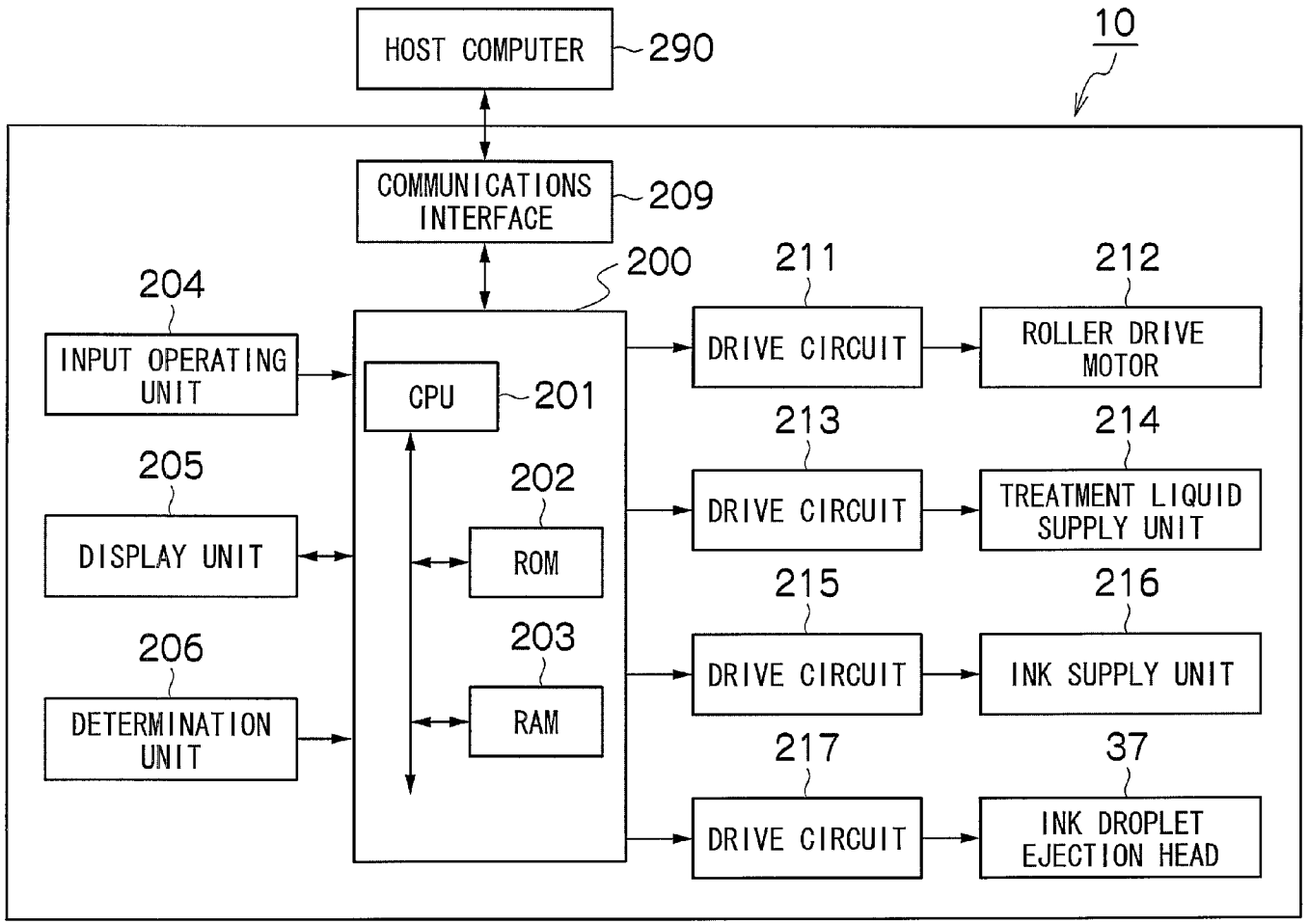
FIG. 5 is a block diagram illustrating the general composition of a control system of an image forming apparatus relating to the first embodiment.

FIG. 5 is a block diagram illustrating the approximate composition of a control system in an image forming apparatus 10 according to the present embodiment. In FIG. 5, the control section 200 controls the whole of the image forming apparatus 10. The control unit 200 comprises: a CPU (Central Processing Unit) 201 which executes processing of various types in accordance with prescribed programs; a ROM (Read Only Memory) 202 which stores programs, and the like; and a RAM (Random Access Memory) 203 which temporarily stores data, and the like, that is used in the various types of processing carried out by the CPU 201. The input operating unit 204 is constituted by a keyboard which is used to input prescribed instructions or data. The display unit 205 is constituted by a liquid crystal display monitor which provides various displays, such as the input and settings status of the image forming apparatus 10.

A determination unit 206 comprising sensors, such as the medium leading edge determination sensors 41, 42 in FIG. 1 is connected to the control unit 200. Furthermore, a communications interface 209 which performs communications with a host computer 290 is connected to the control unit 200. Moreover, a roller drive motor 212 which drives the respective rollers such as the application roller 11 in FIG. 1, a treatment liquid supply unit 214 which supplies treatment liquid to the liquid holding space 20 by means of a treatment liquid supply system (not illustrated), an ink supply unit 216 which supplies ink to the ink droplet ejection head 37 by means of an ink supply system (not illustrated), and the ink droplet ejection head 37, are also connected to the control unit 200 via respective drive circuits 211, 213, 215 and 217.

Density non-uniformity in an image which is caused by variation in the aggregation of the ink as a result of the state of distribution of the treatment liquid is now described with reference to FIG. 6 to FIG. 8.

Figure 6:
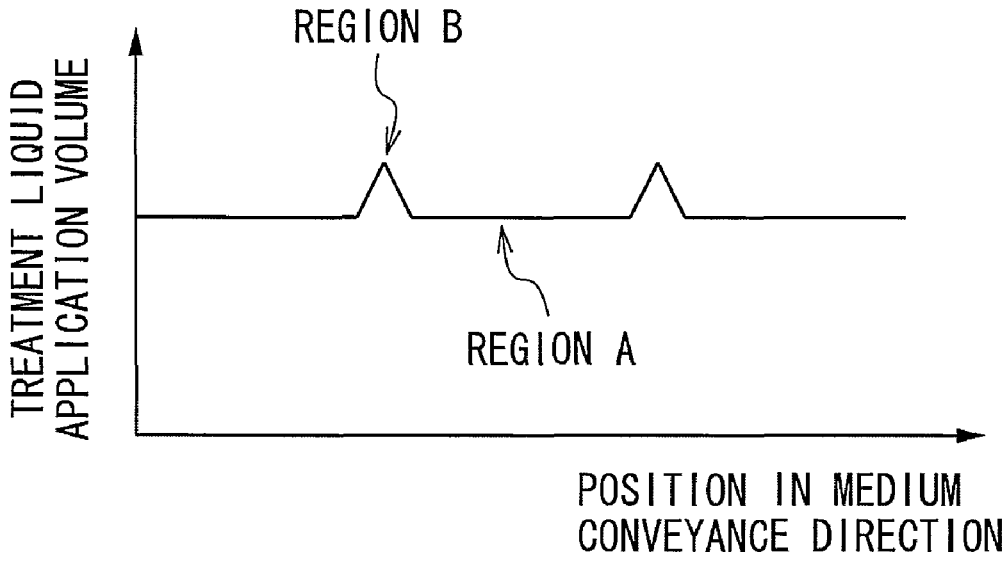
FIG. 6 is an illustrative diagram illustrating the relationship between a position on the medium conveyance direction and the application volume of treatment liquid per unit surface area.

FIG. 6 illustrates the correspondence between the position in the medium conveyance direction of the medium which is conveyed intermittently and the application volume of treatment liquid per unit surface area (which here indicates the thickness of the layer of treatment liquid on the medium).

In FIG. 6, the continuous conveyance region (also called "region A") is a region on the medium which has been coated with the treatment liquid in a state where the medium P lying in contact with the application roller 11 has been conveyed at a uniform speed due to the continuous rotation of the application roller 11 at a uniform speed of rotation. The conveyance halt region (also called "region B") is a region on the medium which has been coated with the treatment liquid in a state of contact with the application roller 11 when the rotation of the application roller 11 is halted and the conveyance of the medium P is halted. In region A, the amount of treatment liquid supplied from the surface of the application roller 11 to the medium P is uniform, and the relationship between the thickness Ta of the layer of treatment liquid in the region A and the thickness Tb of the layer of treatment liquid in the region B is Ta<Tb. In other words, variation occurs in the amount of treatment liquid deposited on the medium.

Figure 7A:
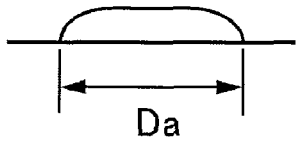
FIGS. 7A and 7B are illustrative diagrams used to describe variation in the aggregation of ink.
Figure 7B:
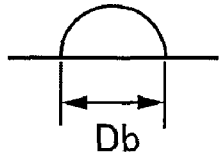

FIG. 7A illustrates an aggregated state of the ink which has been ejected as a droplet onto region A. FIG. 7B illustrates an aggregated state of the ink which has been ejected as a droplet onto region B.

If droplets of the ink are ejected in a solid pattern at a uniform droplet ejection volume onto the medium, then since an excessive amount of the treatment liquid for aggregating the ink is present in region B, compared to region A, the ink aggregating reaction becomes stronger in region B and the extent of contraction of the coloring material becomes greater. As a result, the relationship between the dot diameter Da in region A and the dot diameter Db in region B is Da>Db. In other words, variation occurs in the aggregation of the ink on the medium.

Figure 8:
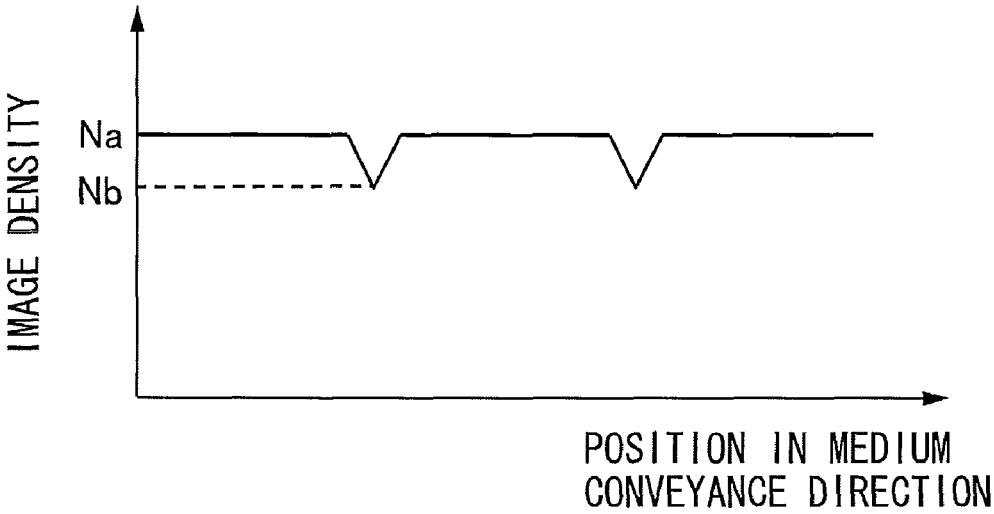
FIG. 8 is an illustrative diagram illustrating the relationship between the position in the medium conveyance direction and the image density.

FIG. 8 illustrates the correspondence between the position in the medium conveyance direction of a medium which is conveyed intermittently, and the density of the image formed on the medium.

In FIG. 8, since the image density depends on the dot area coverage, then the relationship between the image density Na in region A and the image density Nb in region B is Na>Nb. In other words, when the medium is conveyed intermittently, density non-uniformities occur due to the image density being lower in the conveyance halt region (region B), compared to the continuous conveyance region (region A).

One example of droplet ejection correction processing according to the present embodiment is now described with respect to FIG. 9 to FIGS. 12A to 12C.

Figure 9:
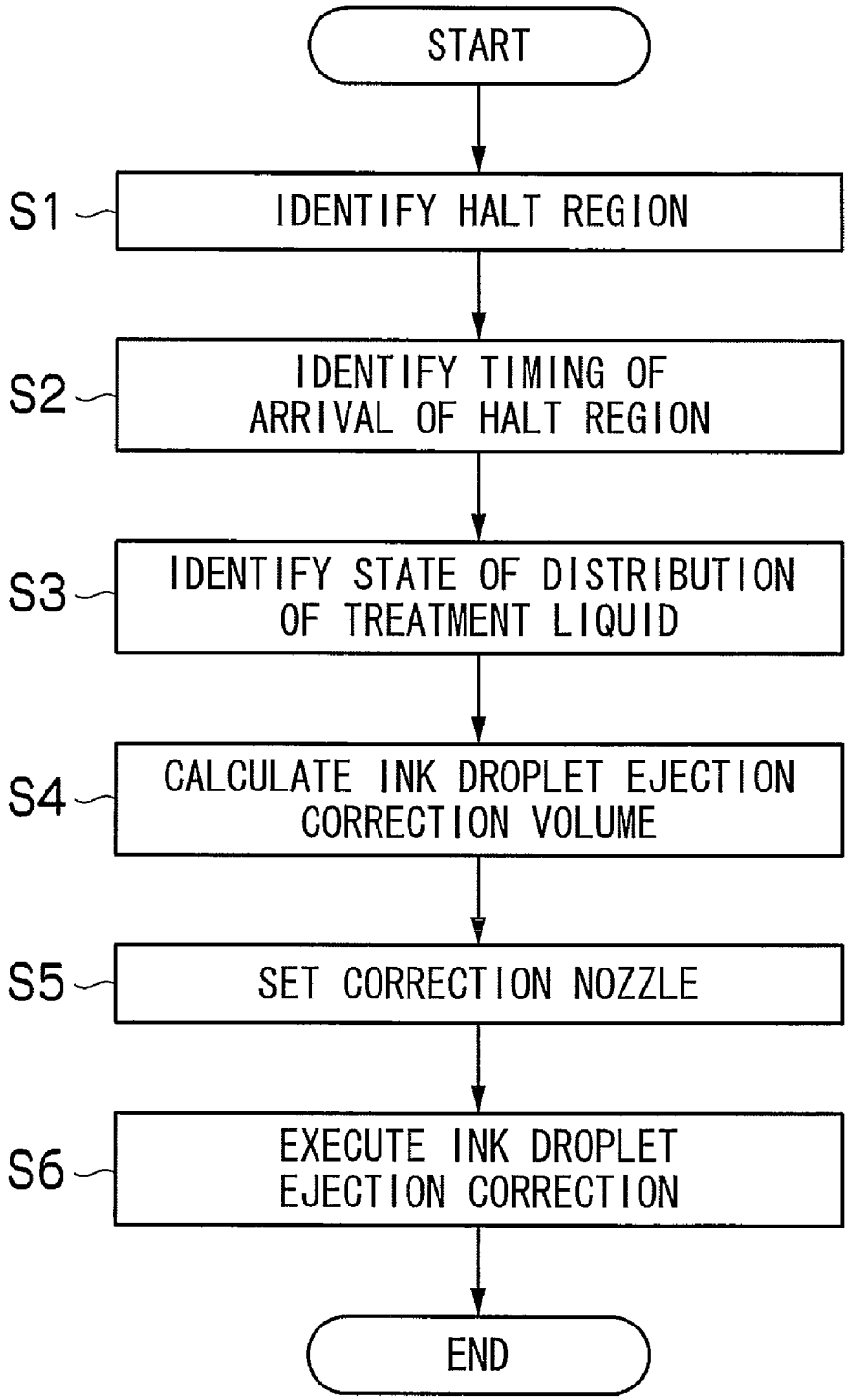
FIG. 9 is a flowchart illustrating the sequence of one example of density correction processing in the first embodiment.

FIG. 9 is a flowchart illustrating the flow of one example of the droplet ejection correction processing which is carried out in accordance with programs by the CPU 201 of the control unit (200 in FIG. 5).

At step S1, the positions on the medium P where treatment liquid is applied when the rotation of the application roller 11 is halted (hereinafter, called "halt positions") are identified. In other words, the halt regions on the medium which lie in contact with the application roller 11 when the conveyance of the medium P is halted are identified as droplet ejection correction regions.

Figure 10:
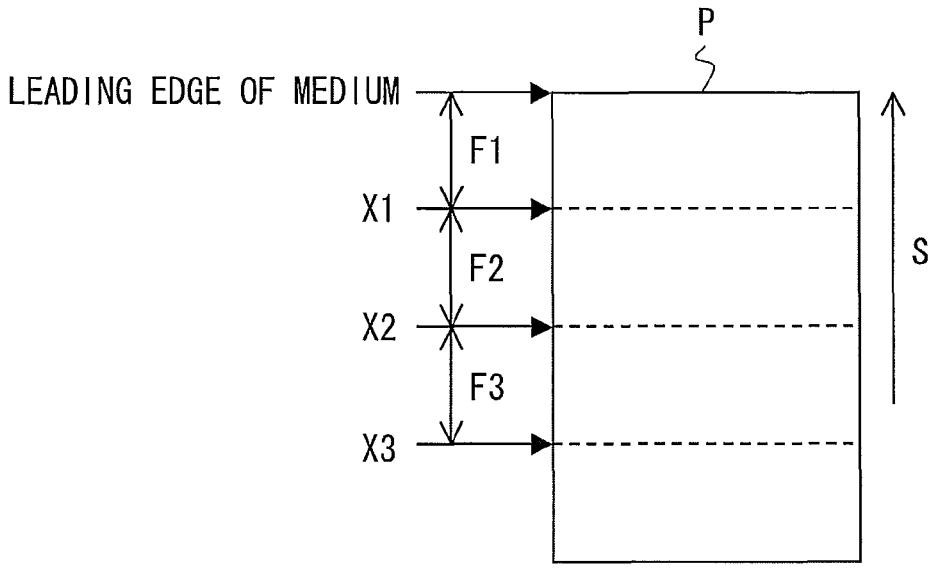
FIG. 10 is an illustrative diagram used to describe halt positions on the medium.

FIG. 10 illustrates an example of halt positions with reference to the leading edge of the medium P. In the present embodiment, the positions (halt positions) on the medium P when the medium P is halted between the application roller 11 and the back-up roller 12 are determined with reference to the leading edge of the medium P which is determined by the first medium leading edge determination sensor 41 disposed between the paper supply unit 31 and the application roller 11. For example, the positions X1, X2 and X3 in FIG. 10 are calculated on the basis of the on/off information of the roller drive motor 212 and the medium feed amounts F1, F2, F3 achieved by the roller drive motor 212. In the present embodiment, the leading edge of the medium P is taken as the point of origin and the medium feed amounts F1, F2, F3 are treated as halt positions and are stored in the RAM 203 for each sheet of the medium P.

At step S2, the timings at which the halt positions on the medium P reach the nozzles of the ink droplet ejection head 37 are identified. In the present embodiment, the leading edge of the medium P is determined by the second medium leading edge determination sensor 42 which is disposed between the application roller 11 and the ink droplet ejection head 37, and furthermore, the halt positions are acquired from the RAM 203 and the timings at which these halt positions reach positions opposing the nozzles 51 of the ink droplet ejection head 37 are identified.

Figure 11:
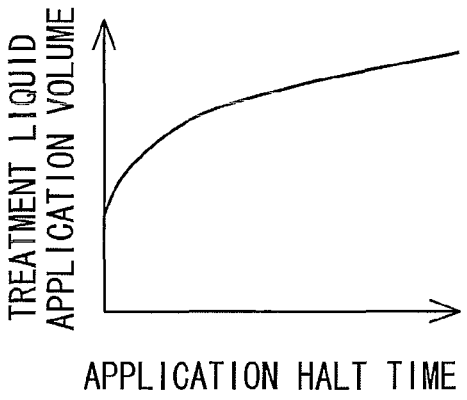
FIG. 11 is an illustrative diagram illustrating the relationship between the halt time and the application volume of treatment liquid per unit surface area.
Figure 12A:
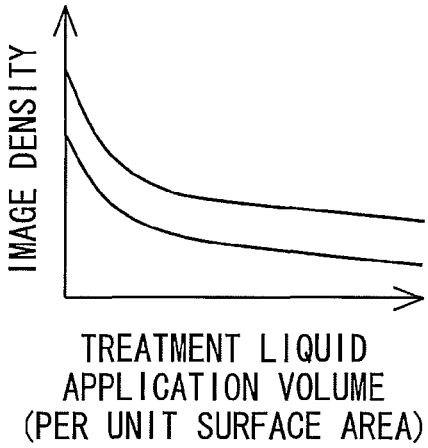
FIG. 12A is an illustrative diagram illustrating the relationship between the image density and the application volume of treatment liquid per unit surface area.
Figure 12B:
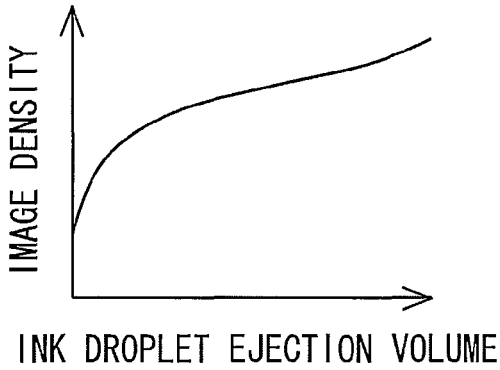
FIG. 12B is an illustrative diagram illustrating the relationship between the image density and the droplet ejection volume of ink per unit surface area.
Figure 12C:
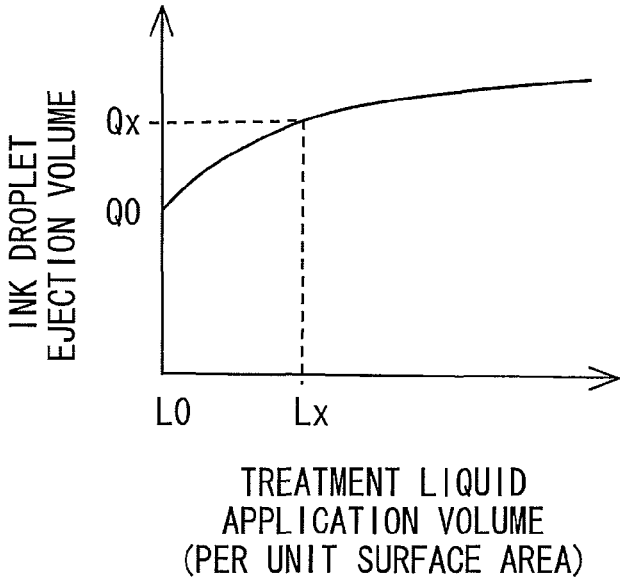
FIG. 12C is an illustrative diagram illustrating the relationship between the application volume of treatment liquid per unit surface area and the droplet ejection volume of ink per unit surface area.

At step S3, the state of distribution of the treatment liquid on the medium P is identified. The present image forming apparatus 10 has a high-speed mode and a high-quality mode as print modes (image forming modes). In the high-quality mode, the speed of movement of the ink droplet ejection head 37 in the main scanning direction M is lower than in the high-speed mode, and the halt time of the medium P during application of treatment liquid is longer. Furthermore, as illustrated in FIG. 11, the longer the halt time, the greater the applied volume of treatment liquid per unit surface area (here, the greater the thickness of the applied layer of treatment liquid). This correspondence between the halt time and the applied volume of treatment liquid per unit surface area is stored previously in a memory (ROM 202 or RAM 203 in FIG. 5) as a table information. In the present embodiment, the applied volume per unit surface area (the thickness of the applied layer) in the conveyance halt region on the medium P is acquired from the memory on the basis of the halt time. The applied volume per unit surface area in the continuous conveyance region on the medium P is treated as a uniform volume. In this way, the state of distribution of the treatment liquid on the medium P (the correspondence between the position on the medium P and the deposition volume of treatment liquid per unit surface area) is acquired.

At step S4, the amount of increase in the ink droplet ejection volume obtained by droplet ejection from the aggregation correction nozzles (namely, the ink droplet ejection correction volume) is determined. In the present embodiment, the correspondence illustrated in FIG. 12C between the applied volume of the treatment liquid per unit surface area and the ink droplet ejection volume which achieves a uniform image density (an ink droplet ejection volume which does not produce non-uniformities in image density as a result of variation in the aggregation of the ink) is determined in advance on the basis of the correspondence illustrated in FIG. 12A between the image density and the applied volume of treatment liquid per unit surface area when droplets are ejected in a solid pattern using a uniform ink droplet ejection volume, and the correspondence illustrated in FIG. 12B between the image density and the ink droplet ejection volume when treatment liquid is applied in a solid pattern using a uniform treatment liquid application volume, and this correspondence is stored in a memory (the ROM 202 or RAM 203 in FIG. 5), in the form of a table. The ink droplet ejection correction volume in the aggregation correction nozzles is determined on the basis of the state of distribution of the treatment liquid on the medium P determined at step S3 and the table information illustrated in FIG. 12C which is acquired from the memory. The ink droplet ejection correction volume is the differential between the ink droplet ejection volume $Q_0$ corresponding to the treatment liquid application volume $L_0$ per unit surface area in the continuous conveyance region and the ink droplet ejection volume $Q_x$ corresponding to the treatment liquid application volume $L_x$ per unit surface area in the conveyance halt region in FIG. 12C. In the present embodiment, the thickness of the applied layer of the treatment liquid applied to the medium P is used as the treatment liquid application volume per unit surface area. If the treatment liquid permeates into the interior of the medium P during a halt in conveyance, the treatment liquid application volume is calculated as the sum total of the application volume on the surface of the medium per unit surface area, and the permeation volume which permeates into the medium per unit surface area.

At step S5, aggregation correction nozzles are identified amongst the nozzles 51 of the ink droplet ejection head 37. In the present embodiment, image density non-uniformities caused by variation in the aggregation of the ink in accordance with the state of distribution of the treatment liquid are corrected (aggregation correction), and image density non-uniformities in joint regions in the conveyance direction S of the medium P caused by variations in the amount of movement of the medium P in the conveyance direction (sub-scanning direction S) are corrected (joint correction); aggregation correction is carried out using nozzles other than the nozzles which are used for joint correction. In other words, the joint correction and the aggregation correction are carried out respectively and independently.

At step S6, ink droplet ejection is corrected. In the present embodiment, by ejecting droplets of ink which are corrected by the ink droplet ejection correction volume determined at step S4, from the aggregation correction nozzles 51 at the timing where the halt position on the medium P reaches a position opposing the aggregation correction nozzles 51 (droplet ejection position), then the image density non-uniformities caused by variation in the aggregation of the ink are corrected. In other words, ink droplets are ejected by aligning the droplet ejection position of the aggregation correction nozzles 51 and the halt position on the medium P, and increasing the droplet ejection volume of the ink at the halt position and the region in the vicinity of same on the medium P, in accordance with the ink droplet ejection correction volume. The droplet ejection volume is changed by altering the drive waveform which is applied to the drive circuit (217 in FIG. 5) of the ink droplet ejection head 37, for example.

Figure 13:
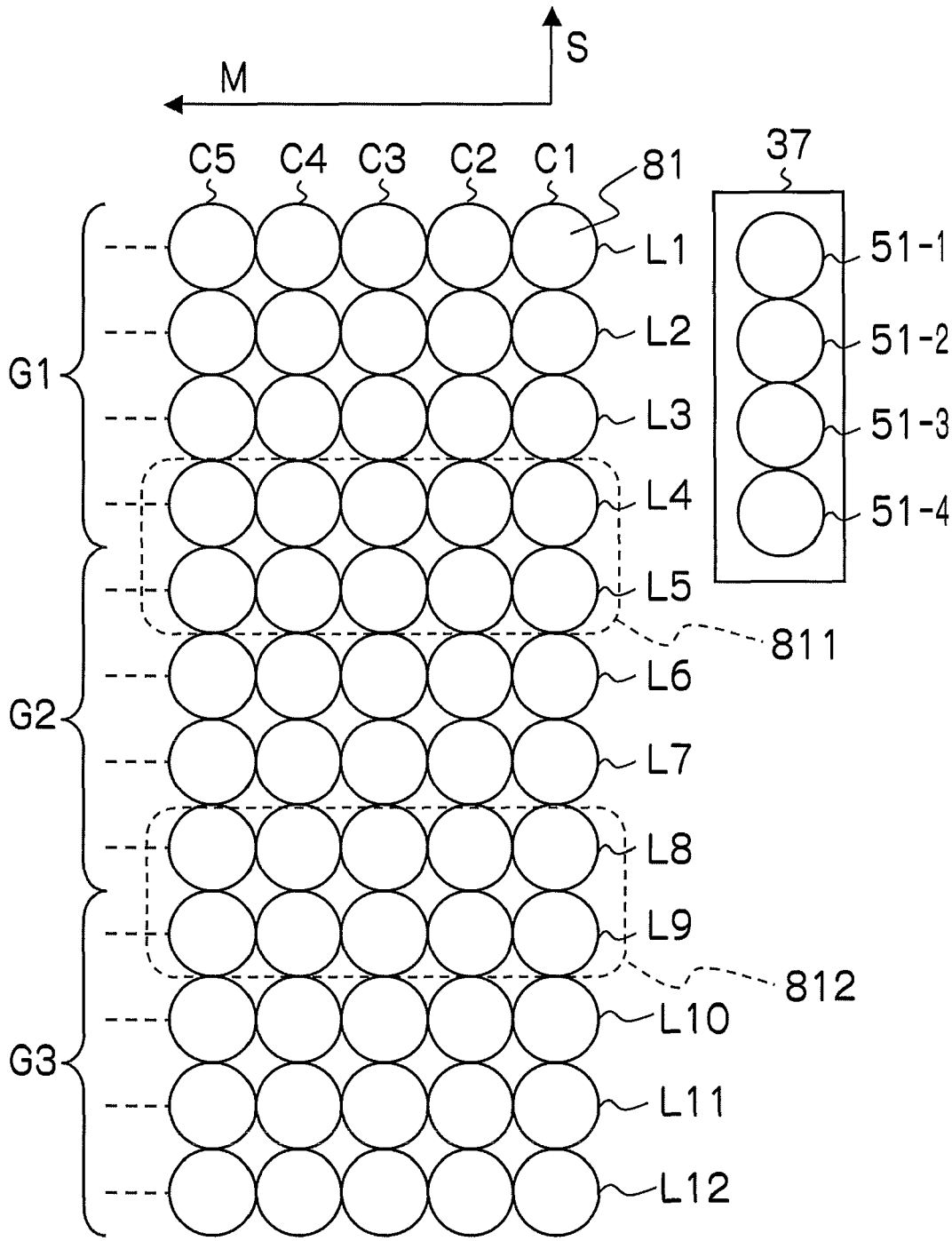
FIG. 13 is an illustrative diagram illustrating a schematic view of the correspondences between correction nozzles and ink dots.

Now, the correspondence between the correction nozzles and the ink dots in a case where the number of nozzles 51 in the ink droplet ejection head 37 is four will be described with reference to FIG. 13. In FIG. 13, the dot rows in the sub-scanning direction S are labeled with reference numerals Li (i=1, 2, 3, . . . ) and the dot rows in the main scanning direction M are labeled with reference numerals Cj (j=1, 2, 3, . . . ). The position of each ink dot is represented by (Cj, Li). For example, the ink droplet ejection head 37 is moved in the main scanning direction M and ink dots 81 are formed in succession, four rows at a time in the sub-scanning direction S, in a first group G1 (L1 to L4), a second group G2 (L5 to L8) and then a third group G3 (L9 to L12). In so doing, L4 and L5 and L8 and L9 are respectively formed by ejecting droplets in a state where there is variation in the amount of conveyance of the medium P in the sub-scanning direction S, and therefore in the joint region 811 which includes the dot rows of L4 and L5 and the joint region 812 which includes the dot rows of L8 and L9, there is a possibility that image density non-uniformities may arise due to local increase or decrease in the density of the image compared to other regions, as a result of the variation in the amount of movement of the medium P in the conveyance direction (sub-scanning direction S). Therefore, in the present embodiment, the ink droplet ejection volume is corrected in order to correct the density non-uniformities in the joint portions 811 and 812 (joint correction), using the first nozzle $\mathbf{51}_{-1}$ and the fourth nozzle $\mathbf{51}_{-4}$. Furthermore, the ink droplet ejection volume is corrected in order to correct the density non-uniformities in the portion where the application volume of treatment liquid is large (region B in FIG. 6) (aggregation correction), using the nozzles (the second nozzle $\mathbf{51}_{-2}$ and the third nozzle $\mathbf{51}_{-3}$) other than the nozzles used for joint correction (the first nozzle $\mathbf{51}_{-1}$ and the fourth nozzle $\mathbf{51}_{-4}$). In the present embodiment, at step S5, the nozzles $\mathbf{51}_{-2}$ and $\mathbf{51}_{-3}$ are identified as aggregation correction nozzles.

In order to give a simple description of the present invention, an example has been described in which shingling is not carried out with the object of reducing image density non-uniformities caused by variation in the flight characteristics of the ink droplets from the respective nozzles 51, but the present invention can also be applied to cases where shingling is carried out. For example, if the number of nozzles of the ink droplet ejection head 37 in the sub-scanning direction is taken as M (for example, "16") and the number of shingling actions which indicates the extent of shingling is taken as K (for example, "4"), then droplet ejection is split into M/K operations. In other words, shingling is carried out using N=M/K (for example, N=4) nozzles in the sub-scanning direction. Here, if the nozzle pitch is taken as Pt, then joint correction is carried out using the nozzles corresponding to the joint region, for each sub-scanning feed amount of L (=N×Pt), and aggregation correction is carried out using nozzles other than the joint correction nozzles.

As described above, the image forming apparatus 10 according to the present embodiment comprises a droplet ejection correction device which acquires the state of distribution of treatment liquid on a medium P, and corrects image density non-uniformities caused by variation in the aggregation of the ink due to variation in the speed of conveyance of the medium P by correcting the ink droplet ejection volume ejected from the ink droplet ejection head 37 in accordance with the acquired state of distribution.

Furthermore, the image forming apparatus 10 according to the present embodiment comprises a droplet ejection correction region identification device which identifies a droplet ejection correction region where the deposition volume of treatment liquid on the medium P varies due to variation in the conveyance speed of the medium. In other words, the halt regions on the medium which lie in contact with the application roller 11 when the conveyance of the medium P is halted are identified as droplet ejection correction regions. Here, the longer the halt time of the medium P, the greater the increase applied to the droplet ejection volume of the ink for the halt region on the medium P. In other words, the greater the deposition volume of treatment liquid per unit surface area in a region of the medium P, the greater the increase applied to the ink droplet ejection volume for that region. For example, the greater the thickness of the layer of treatment liquid in a region of the medium P, the greater the increase applied to the ink droplet ejection volume for that region. More specifically, the longer the halt time of the application roller 11, the greater the increase applied to the ink droplet ejection volume for the halt region on the medium P.

The droplet ejection correction volume is not necessarily limited to being determined on the basis of the halt time, and the ink droplet ejection volume may also be determined directly on the basis of the speed of movement of the ink droplet ejection head 37 in the main scanning direction M during the application of treatment liquid. More specifically, the lower the speed of movement of the ink droplet ejection head 37 in the main scanning direction M, then the greater the amount of correction applied to the ink droplet ejection volume in the halt region of the medium P.

In the present embodiment, the droplet ejection correction device is principally constituted by the control unit (200 in FIG. 5) and the drive circuit (217 in FIG. 5) for the ink droplet ejection head 37. Furthermore, the droplet ejection correction region identification device principally comprises the first medium leading edge determination sensor (41 in FIG. 1) and the control unit 200. An alignment device which aligns the positions of the droplet ejection correction region and the correction nozzles is principally constituted by the second medium leading edge determination sensor (42 in FIG. 1), the roller drive motor drive circuit (211 in FIG. 5) and the control unit 200.

In the foregoing, a case where the conveyance of the medium P is halted in accordance with the reciprocal movement of the ink droplet ejection head 37 in the main scanning direction is described as an example, but the present invention is not limited to cases of this kind. The present invention may of course also be applied to a case where the conveyance of the medium P is not halted but the conveyance speed varies. For example, a region on the medium where treatment liquid is applied by making contact with the application roller 11 in a state where the medium is conveyed at a uniform conveyance speed (uniform speed region), and a region on the medium where treatment liquid is applied by making contact with the application roller 11 in a state where the conveyance speed of the medium is lower (or higher) than the aforementioned uniform speed (speed variation region) are determined, and the speed variation region is identified as a droplet ejection correction region. For example, the greater the difference between the thickness of the layer of treatment liquid on the uniform speed region (the deposition volume per unit surface area in the uniform speed region) and the thickness of the layer of treatment liquid on the speed variation region (the deposition volume per unit surface area in the speed variation region), the greater the increase applied to the ink droplet ejection volume in the speed variation region.

In the image forming apparatus 10 illustrated in FIG. 1, the medium conveyance device which conveys the medium P relatively with respect to the application roller 11 and the ink droplet ejection head 37 is principally constituted by the application roller 11 and the conveyance rollers 34 and 35. In the present embodiment, the application roller 11 is rotated and the medium P moves passively in accordance with this, but the invention is not limited in particular to this, and the present invention may of course also be applied to a mode in which the application roller 11 moves passively due to the conveyance of the medium. For example, in FIG. 1, in a composition in which an intermediate conveyance roller is provided between the paper supply roller 32 and the application roller 11, it is possible to correct the droplet ejection volume of the ink in accordance with the variation in the rotational speed of the intermediate conveyance roller during the application of treatment liquid.

Furthermore, although a mode has been described in which the medium P is moved with respect to both the application roller 11 and the ink droplet ejection head 37, the present invention is not limited to a mode of this kind. The present invention of course also encompasses a mode in which both the application roller and the ink droplet ejection head are moved with respect to the medium P, rather than moving the medium P. Here, the medium conveyance direction is the direction in which the medium P is moved with respect to both the application roller 11 and the ink droplet ejection head 37 (the sub-scanning direction S). The relationship between the application roller 11 and the medium P is not limited to a case in which the medium is conveyed in a state where the surface of the medium P does not slide with respect to the surface of the application roller 11, and the present invention also encompasses a case where the medium is conveyed in a state where the surface of the medium P slides with respect to the surface of the application roller 11.

Figure 15A:
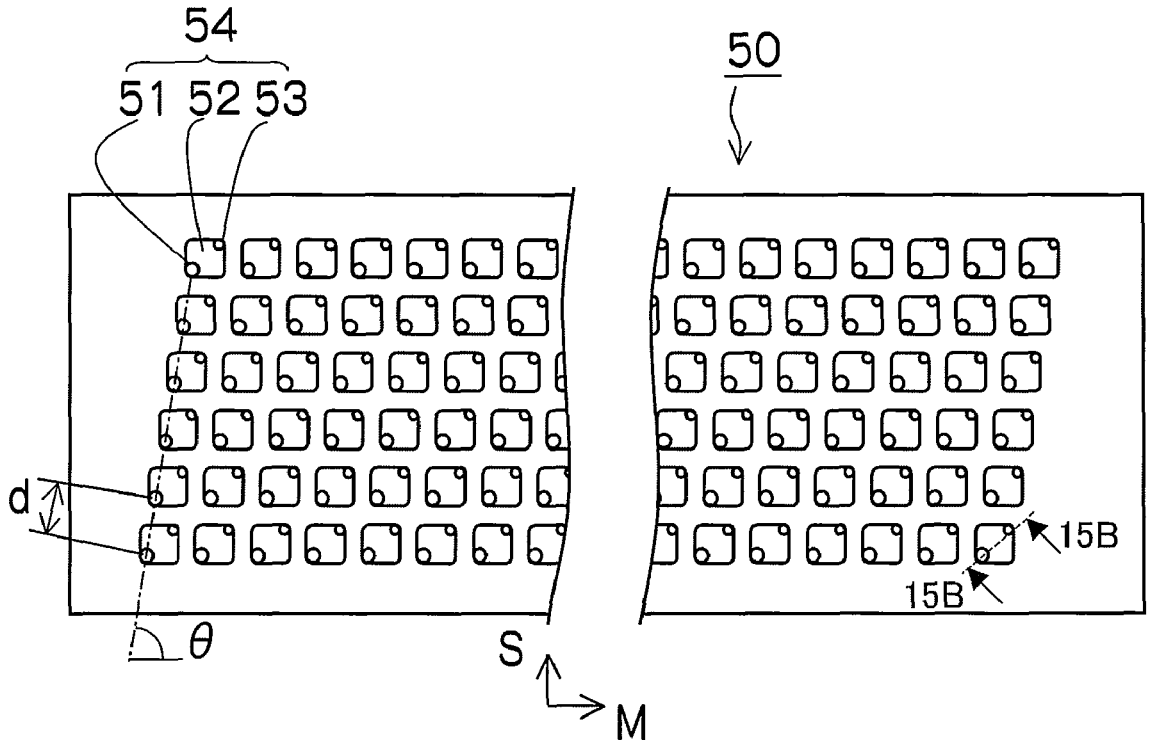
FIG. 15A is a plan diagram illustrating one example of an ink droplet ejection head and a treatment liquid droplet ejection head.
Figure 15B:
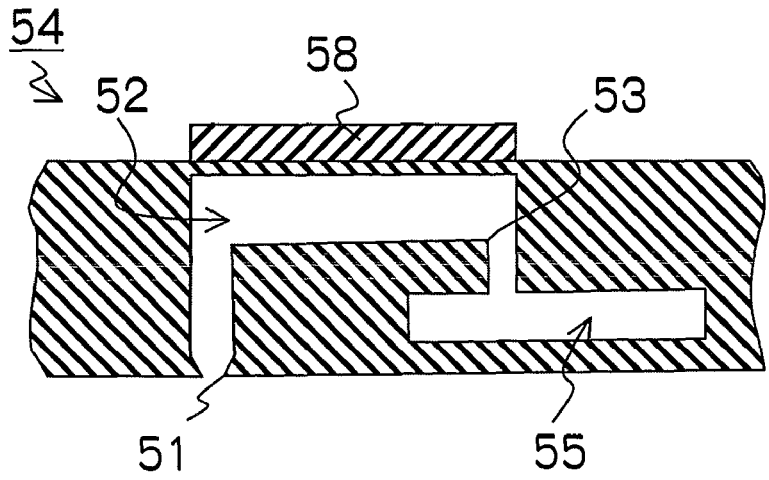
FIG. 15B is a cross-sectional view along line 15B-15B in FIG. 15A.

Furthermore, an example has been described in which a shuttle type of droplet ejection head illustrated in FIG. 3 is used as the ink droplet ejection head 37, but the present invention can of course also be applied to a full line type of droplet ejection head 50 as illustrated in FIGS. 15A and 15B, which is described hereinafter.

Second Embodiment

In the present embodiment, a droplet ejection head having a plurality of nozzles (hereinafter, a "treatment liquid droplet ejection head") is used as a treatment liquid deposition device which deposits treatment liquid onto the medium. Furthermore, in the present embodiment, density non-uniformities in the image caused by aggregation non-uniformities of the ink on the medium are corrected by correcting the ink droplet ejection volume in accordance with the overlapping surface area (extent of overlap) of the treatment liquid dots and ink dots formed on the medium.

Figure 14:
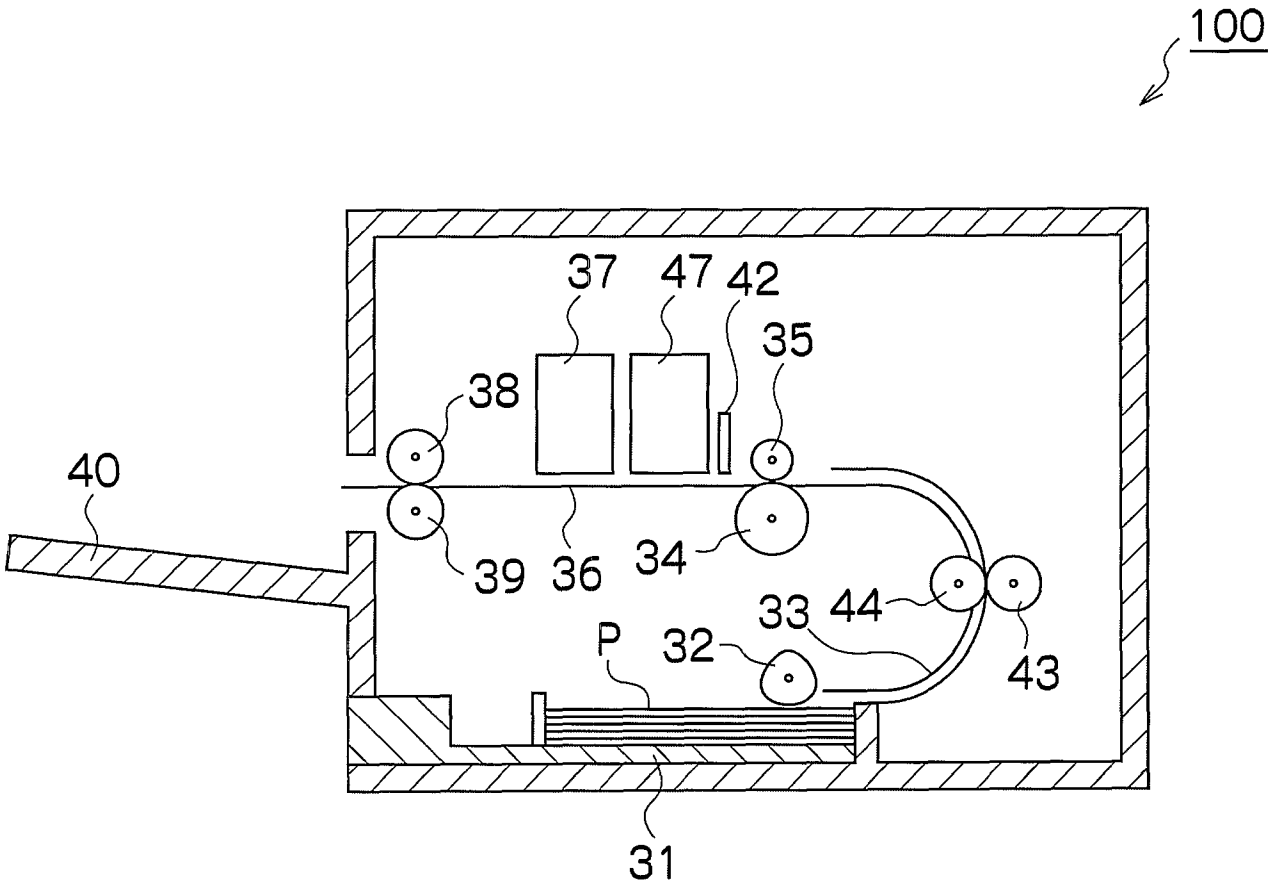
FIG. 14 is a general schematic drawing of an ink forming apparatus relating to a second embodiment of the present invention.

FIG. 14 is a general schematic drawing of an image forming apparatus 100 according to a second embodiment which employs a droplet ejection apparatus relating to an embodiment of the present invention. The same reference numerals are assigned to constituent elements which are the same as the constituent elements of the image forming apparatus 10 of the first embodiment which is illustrated in FIG. 1, and details which have already been described are not explained further here.

In FIG. 14, the treatment liquid droplet ejection head 47 is disposed between the ink droplet ejection head 37 and the conveyance rollers 34 and 35, and droplets of treatment liquid are ejected onto the medium P before ejecting droplets of ink. The intermediate conveyance rollers 43 and 44 convey a medium P which has been supplied from the paper supply unit 31 by the paper supply roller 32, toward the conveyance rollers 34 and 35.

FIG. 15A is a plan view perspective diagram illustrating the general composition of a liquid ejection head 50 (droplet ejection head) which is one example of the ink droplet ejection head 37 and the treatment liquid droplet ejection head 47 in FIG. 14. The liquid ejection head 50 illustrated as an example in FIG. 15A is a so-called full line type of liquid ejection head, having a structure in which a plurality of nozzles 51 which eject droplets of inks toward a medium are arranged in a two-dimensional configuration through a length corresponding to the width of the medium in the direction perpendicular to the direction of conveyance of the medium (the sub-scanning direction S), (in other words, the main scanning direction M). The liquid ejection head 50 comprises a plurality of liquid ejection elements 54, each comprising a nozzle 51 which ejects droplets of liquid, a pressure chamber 52 connected to a nozzle 51, and a liquid supply port 53 for supplying liquid to the pressure chamber 52, the recording elements 54 being arranged in two directions, namely, the main scanning direction M and an oblique direction forming a prescribed acute angle $\theta$ (where $0° < \theta < 90°$) with respect to the main scanning direction M. In FIG. 15A, in order to simplify the drawing, only a portion of the liquid ejection elements 54 are depicted in the drawing. In specific terms, the nozzles 51 are arranged at a uniform pitch d in the direction forming the prescribed acute angle of $\theta$ with respect to the main scanning direction M, and hence the nozzle arrangement can be treated as equivalent to a configuration in which nozzles are arranged at an interval of $d \times \cos\theta$ in a single straight line following the main scanning direction M.

Furthermore, FIG. 15B illustrates a cross-sectional diagram along line 15B-15B in FIG. 15A. In FIG. 15B, each liquid ejection element 54 comprises a nozzle 51 which ejects liquid, a pressure chamber 52 which is connected to the nozzle 51 and into which liquid is filled, a liquid supply port 53 for supplying liquid to the pressure chamber 52, a common flow channel 55 which is connected to the pressure chamber 52 via the liquid supply port 53, and a piezoelectric element 58 which forms an actuator for changing the pressure inside the pressure chamber 52. FIG. 15B illustrates only one liquid ejection element 54, in order to simplify the illustration, but the liquid ejection head 50 actually is constituted by a plurality of liquid ejection elements 54 which are arranged in a two-dimensional configuration as illustrated in FIG. 15A. In other words, in practice, the liquid ejection head 50 comprises a plurality of nozzles 51, a plurality of pressure chambers 52, a plurality of liquid supply ports 53 and a plurality of piezoelectric elements 58.

Figure 16:
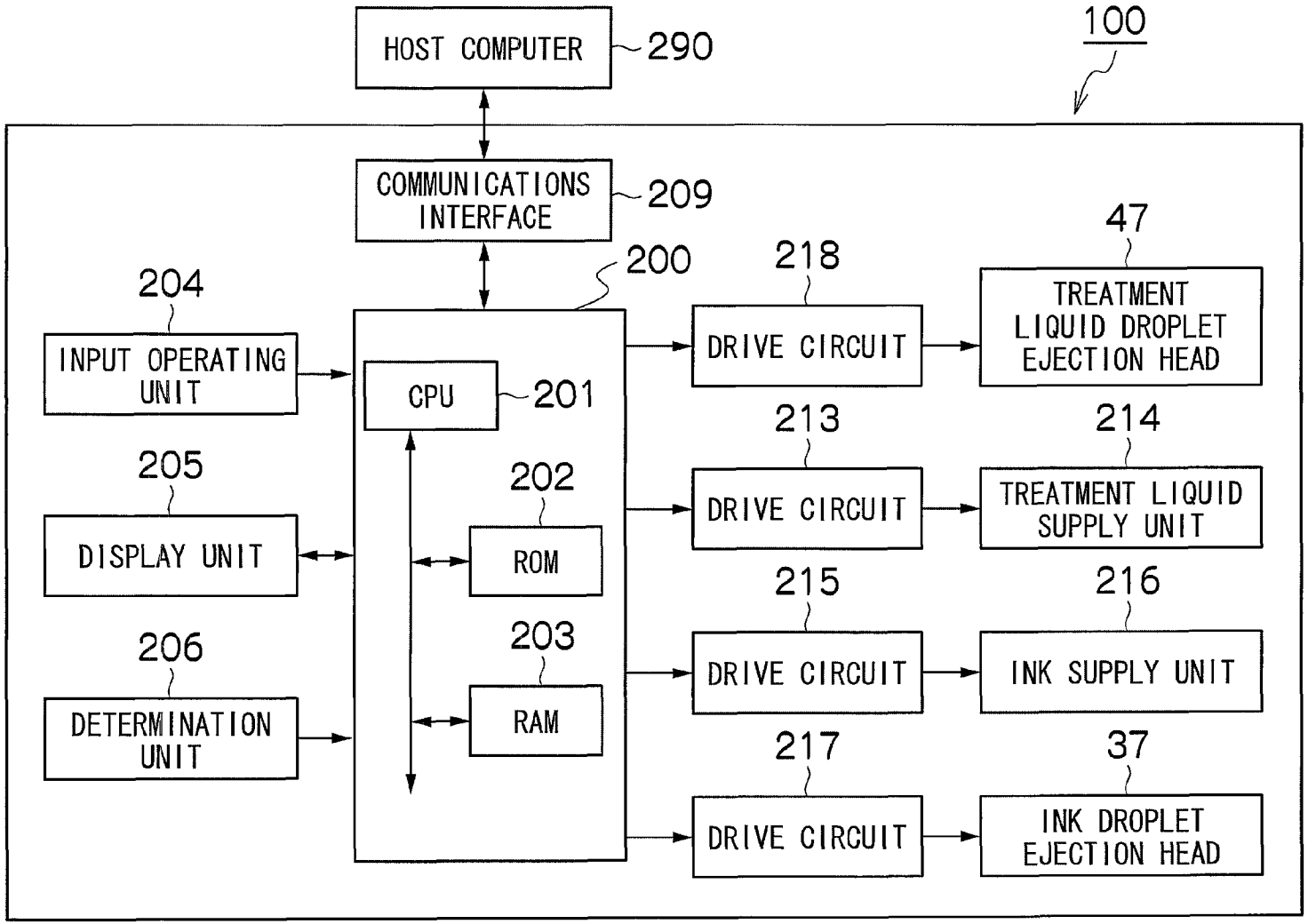
FIG. 16 is a block diagram illustrating the general composition of a control system of an image forming apparatus relating to the second embodiment.

FIG. 16 is a block diagram illustrating the approximate composition of a control system in an image forming apparatus 100 according to the present embodiment. The same reference numerals are assigned to constituent elements which are the same as the constituent elements of the image forming apparatus 10 of the first embodiment which is illustrated in FIG. 5, and details which have already been described are not explained further here.

In FIG. 16, the treatment liquid droplet ejection head 47 is connected to the control unit 200 via a drive circuit 218 which drives the treatment liquid droplet ejection head 47.

Figure 17:
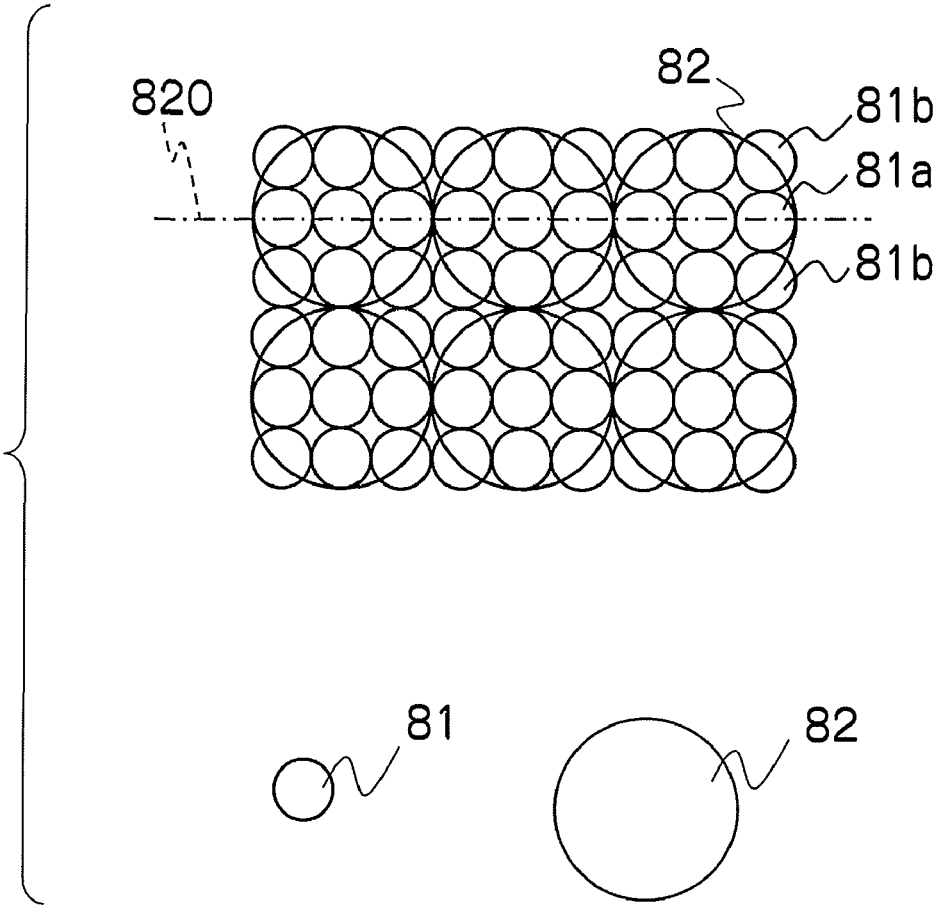
FIG. 17 is an illustrative diagram illustrating one example of the state of overlap between the ink dots and the treatment liquid dots.

FIG. 17 illustrates one example of the state of overlap between the ink dots 81 (81*a*, 81*b*) and the treatment liquid dots 82. The ink dots 81 and the treatment liquid dots 82 comprise liquid droplets which are ejected from the nozzles of the ink droplet ejection head 37 and the nozzles of the treatment liquid droplet ejection head 47 to form dots on the medium. In general, high resolution is required in the ink dots 81 in order to form an image of high quality, whereas resolution of the same level as the ink dots 81 is not required in the treatment liquid dots 82. In the case of the present embodiment, the resolution of the treatment liquid dots 82 is three times the resolution of the ink dots 81. In this case, the diameter of the treatment liquid dots 82 is three times the diameter of the ink dots 81.

Compared to the ink dots 81*a* which are formed by ejection of droplets onto the central line 820 of the treatment liquid dots 82, the ink dots 81*b* formed by ejection of droplets at positions deviated from the central line 820 have a smaller overlap surface area with the treatment liquid dots 82. Since a difference in aggregation occurs between the ink dots 81*a* and 81*b* due to this difference in the overlapping surface area (extent of overlap), then when the whole image is viewed, a line-shaped or granular density non-uniformity occurs.

In the present embodiment, by correcting the ink droplet ejection volume of the droplets ejected from the nozzles 51 of the ink droplet ejection head 37 in accordance with the overlapping surface area between the treatment liquid dots 82 and the ink dots 81 formed on the medium, then density non-uniformities in the image caused by variation in the aggregation of ink in accordance with the state of distribution of the treatment liquid on the medium are duly corrected.

More specifically, of the plurality of ink dots 81 on the medium, the ink dots 81*a* which have a relatively large overlapping surface area with the treatment liquid dots 82 are corrected so as to increase the ink droplet ejection volume in comparison with ink dots 81*b* which have a relatively small overlapping surface area. The amount of increase in the droplet ejection volume (correction volume) is decided in accordance with the overlapping surface area between the ink dot 81 and the treatment liquid dots 82. The overlapping surface area is set in the apparatus design stage, for example.

The overlapping surface area for each nozzle of the ink droplet ejection head 37 is stored previously in a memory (for example, the ROM 202 or the RAM 203) as information which indicates the state of distribution of the treatment liquid dots. This information is acquired from the memory when ejecting droplets of ink. However, it is also possible to store the amount of increase in the droplet ejection volume for each of the nozzles of the ink droplet ejection head 37, previously in a memory, and to acquire this information from the memory. Moreover, if the treatment liquid dots are thinned out, the amount of increase in the droplet ejection volume is switched in accordance with this thinning out.

The positional relationships are subject to manufacturing variations between apparatuses, and therefore it is desirable to measure the positional relationships respectively in each apparatus. For example, droplets of cyan colored ink are ejected from the ink droplet ejection head 37 and droplets of magenta colored ink are ejected from the treatment liquid droplet ejection head 47 to form dots on a medium which is read in by an image sensor, and the positional relationships described above are measured. Thereupon, the liquid supplied to the treatment liquid droplet ejection head 47 is switched from ink to treatment liquid.

The present invention is not limited to the examples described in the present specification or illustrated in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection apparatus, comprising:

a treatment liquid deposition device which deposits treatment liquid aggregating ink onto a medium;

an ink droplet ejection device which ejects droplets of ink onto the medium on which the treatment liquid has been deposited;

a droplet ejection correction device which corrects a droplet ejection volume of the ink droplet ejection device in accordance with distribution of the treatment liquid on the medium;

a medium conveyance device which conveys the medium relatively with respect to the treatment liquid deposition device and the ink droplet ejection device: and a droplet ejection correction region identification device which identifies a droplet ejection correction region in which a deposition volume of the treatment liquid on the medium changes in accordance with variation in a conveyance speed of the medium by the medium conveyance device, wherein the treatment liquid deposition device is an application roller which applies the treatment liquid while making contact with the medium, and wherein the droplet ejection correction device corrects the droplet ejection volume of the ink droplet ejection device onto the droplet ejection correction region identified by the droplet ejection correction region identification device.

2. The droplet ejection apparatus as defined in claim 1, wherein:

the ink droplet ejection device is an ink droplet ejection head which ejects the droplets of ink onto the medium while moving reciprocally back and forth in a main scanning direction which is perpendicular to a medium conveyance direction in which the medium is conveyed by the medium conveyance device, and the medium conveyance device performs intermittent conveyance which repeats conveyance and halting of the medium in contact with the application roller, in accordance with the movement of the ink droplet ejection head.

3. The droplet ejection apparatus as defined in claim 2, wherein the droplet ejection correction device raises an amount of increase in the droplet ejection volume onto a halt region on the medium which lies in contact with the application roller when the medium is halted, as a halt time when the medium is halted becomes longer.

4. The droplet ejection apparatus as defined in claim 2, wherein the droplet ejection correction device raises an amount of increase in the droplet ejection volume onto a halt region on the medium which lies in contact with the application roller when the medium is halted, as a speed of movement of the ink droplet ejection head in the main scanning direction during application of the treatment liquid becomes lower.

5. The droplet ejection apparatus as defined in claim 2, wherein:

the ink droplet ejection head has a plurality of nozzles, and the droplet ejection correction device performs aggregation correction of correcting density non-uniformities of an image caused by variation in aggregation of the ink in accordance with variation in deposition of the treatment liquid onto the medium, and joint correction of correcting density non-uniformities of an image in a joint region on the medium in terms of the medium conveyance direction caused by variation in an amount of movement of the medium in the medium conveyance direction, the aggregation correction being carried out by using a nozzle other than a nozzle used for the joint correction, of the plurality of nozzles of the ink droplet ejection head.

6. The droplet ejection apparatus as defined in claim 1 wherein:

the droplet ejection correction region identification device identifies, as the droplet ejection correction region, a halt region on the medium which lies in contact with the application roller when the medium is halted, and the droplet ejection correction device increases the droplet ejection volume of the ink droplet ejection device onto the halt region.

7. A droplet ejection apparatus, comprising:

a treatment liquid deposition device which deposits treatment liquid aggregating ink onto a medium;

an ink droplet ejection device which ejects droplets of ink onto the medium on which the treatment liquid has been deposited; and a droplet ejection correction device which corrects a droplet ejection volume of the ink droplet ejection device in accordance with distribution of the treatment liquid on the medium, wherein the droplet ejection correction device raises an amount of increase in the droplet ejection volume onto a region of the medium, as a deposition volume of the treatment liquid per unit surface area is greater.

8. The droplet ejection apparatus as defined in claim 7, wherein the droplet ejection correction device raises the amount of increase in the droplet ejection volume onto a region of the medium, as a thickness of a layer of the treatment liquid is greater.

9. A droplet ejection apparatus, comprising:

a treatment liquid deposition device which deposits treatment liquid aggregating ink onto a medium;

an ink droplet ejection device which ejects droplets of ink onto the medium on which the treatment liquid has been deposited; and a droplet ejection correction device which corrects a droplet ejection volume of the ink droplet ejection device in accordance with distribution of the treatment liquid on the medium, wherein:

the treatment liquid deposition device has a plurality of nozzles which eject droplets of the treatment liquid onto the medium, and the droplet ejection correction device corrects the droplet ejection volume of the ink droplet ejection device in accordance with an overlapping surface area of treatment liquid dots and ink dots formed on the medium.

10. The droplet ejection apparatus as defined in claim 9, wherein the droplet ejection correction device raises an amount of increase in the droplet ejection volume for an ink dot with a greater overlapping surface area with the treatment liquid dot, of the ink dots on the medium.

11. A droplet ejection method of ejecting droplets of ink onto a medium on which treatment liquid aggregating the ink has been deposited, the droplet ejection method comprising the step of correcting a droplet ejection volume of an ink droplet ejection device in accordance with distribution of the treatment liquid on the medium, wherein:

an application roller which applies the treatment liquid while making contact with the medium, an ink droplet ejection device which ejects the droplets of ink onto the medium on which the treatment liquid has been deposited, and a medium conveyance device which conveys the medium relatively with respect to the application roller and the ink droplet ejection device, are used, and a droplet ejection correction region in which a deposition volume of the treatment liquid on the medium changes in accordance with variation in a conveyance speed of the medium by the medium conveyance device is identified, and the droplet ejection volume of the ink droplet ejection device is corrected for the droplet ejection correction region.

12. A droplet ejection method of ejecting droplets of ink onto a medium on which treatment liquid aggregating the ink has been deposited, the droplet ejection method comprising the step of correcting a droplet ejection volume of an ink droplet ejection device in accordance with distribution of the treatment liquid on the medium, wherein:

a treatment liquid droplet ejection head having a plurality of nozzles which eject droplets of the treatment liquid onto the medium, and an ink droplet ejection head having a plurality of nozzles which eject the droplets of ink onto the medium on which the droplets of the treatment liquid have been ejected, are used, and the droplet ejection volume of the ink droplet ejection head is corrected in accordance with an overlapping surface area between treatment liquid dots formed on the medium by the treatment liquid droplet ejection head and ink dots formed on the medium by the ink droplet ejection head.

* * * * *